US005197454A

United States Patent [19]

Lee

[11] Patent Number: 5,197,454

[45] Date of Patent: Mar. 30, 1993

[54] CANDLE HOLDER

[76] Inventor: Hung H. Lee, No. 77, Lane 508, Chung Cheng Pei Rd., San Chung City, Taipei Hsien, Taiwan

[21] Appl. No.: 832,032

[22] Filed: Feb. 6, 1992

[51] Int. Cl.[5] ..... F24C 1/16

[52] U.S. Cl. ..... 126/9 R; 126/45; 126/47; 126/258; 126/256

[58] Field of Search ..... 126/45, 43, 44, 46, 126/47, 48, 49, 9 R, 358, 258, 256; 431/125, 335

[56] References Cited

U.S. PATENT DOCUMENTS 3,286,492 11/1966 Frazier, Jr. ..... 431/126 X
3,385,084 5/1968 MacDonald ..... 431/125 X
3,703,166 11/1972 White, Jr. et al. ..... 126/44
4,646,213 2/1987 Fanelli et al. ..... 126/47 X

*Primary Examiner*—Larry Jones
*Attorney, Agent, or Firm*—Varndell Legal Group

[57] ABSTRACT

A candle holder with devices for allowing fragrance to be volatilized and for warming a cup. The candle holder has a base with a holder attached thereto and a positioning seat with a socket formed therein. A plurality of vents are formed in the base which introduces fresh air into a wind shield which is placed around the seat. A top of the wind shield is placed a bowl on which fragrance is deposited. On top of the bowl is an upper supporting device on which a cup is placed.

11 Claims, 6 Drawing Sheets

CANDLE HOLDER

BACKGROUND OF THE INVENTION

The present invention relates to an improved candle holder, and more particularly to an improved candle holder which also functions as a fragrance burner and as a warming device for a cup.

At the present time, candles only serve as an auxiliary light source during power failures or as some type of novelty device. In either of these cases, only the light from the candle is utilized, not the heat generated thereby. Therefore, there is an unfulfilled market for a candle holder which utilizes the heat from a candle to serve as further functions other than that of providing light.

SUMMARY OF THE INVENTION

According to one aspect of the present invention, a candle holder includes a base with a handle attached at one end thereof, an extinguisher held by the handle, a wind shield disposed on the other end of the base, a bowl placed on the top of the wind shield, and an upper supporting means placed on the top of the bowl.

The bowl forms a recess in which fragrance can be put, whereby heat from the candle will volatilize the fragrance so as to perfume the air.

The users may also place a cup on the top of the upper supporting means, whereby heat from the candle will warm the cup.

It is an object of the present invention to provide an improved candle holder which functions as a warming device for a cup.

It is another object of the present invention to provide an improved candle holder which volatilizes a fragrance.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
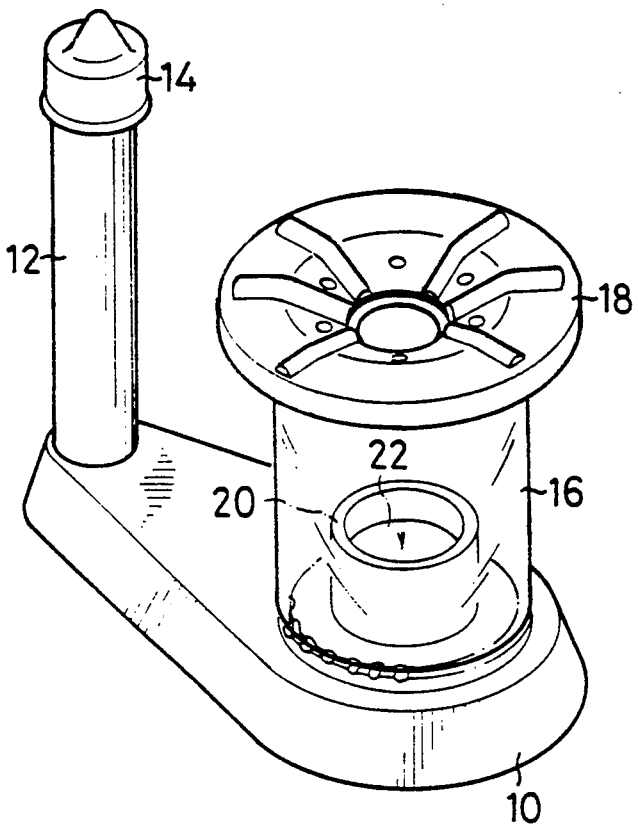
FIG. 1 is a perspective view of a candle holder in accordance with the present invention.

Referring to the drawings, initially to FIG. 1, a candle holder in accordance with the present invention is shown in a preferred embodiment and generally comprises a bases 10 with a handle 12 attached at one end thereof, an extinguisher 14 placed on top of the handle 12, a wind shield 16 disposed on the other end of the base 1C which is made of transparent material or the like, an upper supporting means 18 placed on top of the wind shield 16, a candle retainer 20 disposed within the wind shield 14, and a candle 22 disposed in the handle retainer 20.

Figure 2:
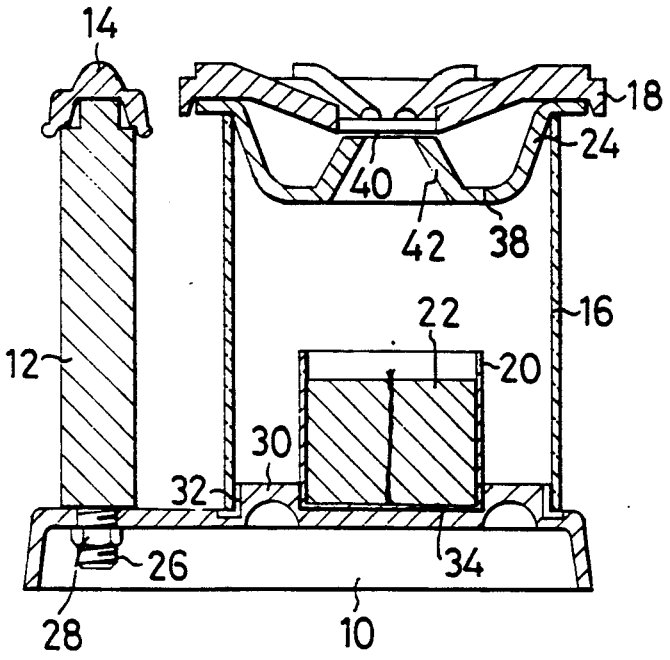
FIG. 2 is a cross-sectional view of the candle holder.

With still further reference to FIG. 2, the handle 12 is attached to the base 10 which in a lower end of the handle 12 is machined a screwed surface 26 by a screw 28 fixed thereon. The top of the handle 12 substantially conforms to an inside of the extinguisher 14 to facilitate attached thereon.

A positioning seat 30 is formed in the base 10 around which the wind shield 16 is disposed and has a plurality of vents 32 formed in peripheral wall thereof through which fresh air is introduced into the wind shield 16. A socket 34 is formed within the positioning seat 30 for receiving the candle retainer 20 therein.

Figure 3:
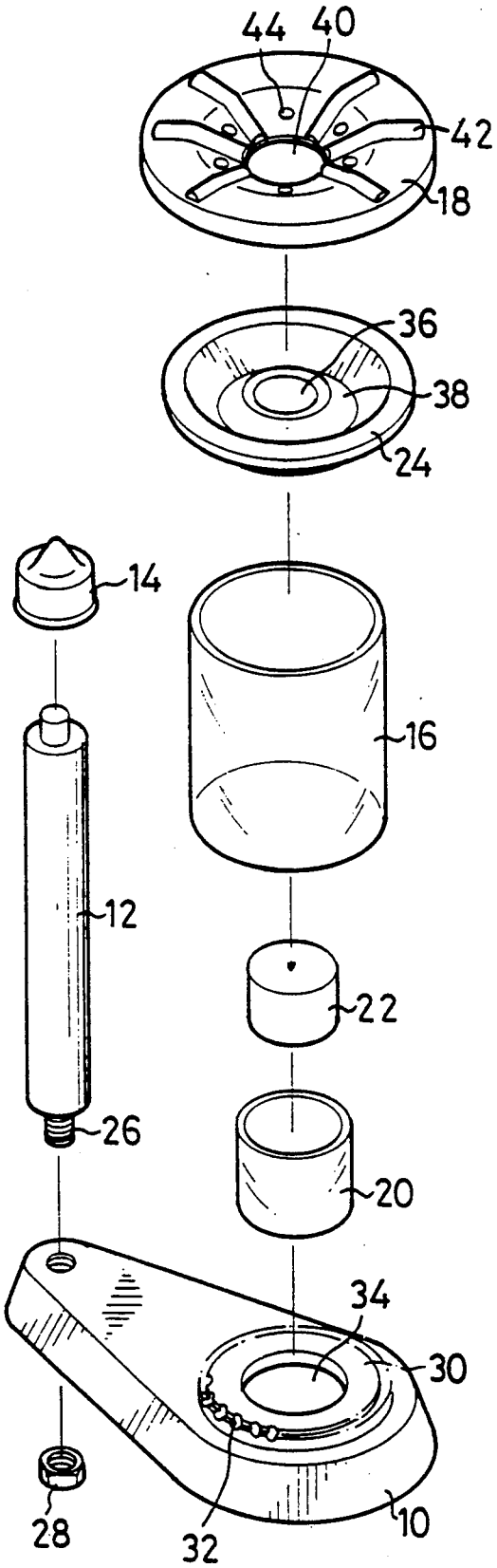
FIG. 3 is an exploded view of the candle holder.

With further reference to FIG. 3, the candle holder further comprises a bowl 24 disposed between the wind shield 16 and the upper supporting means 18. The bowl 24 has an opening 36 formed in middle portion thereof, defining an upwardly-conical portion around which a recess 38 is formed for holding fragrance.

The upper supporting means 18 forms a downwardly-conical wall and has an opening 40, comparable with that the bowl 24, formed in middle portion thereof. A plurality of protuberant ribs 42 and a plurality of holes 44 are formed in the supporting means 24 on which a cup is placed and through which heat is transferred, respectively.

Figure 4:
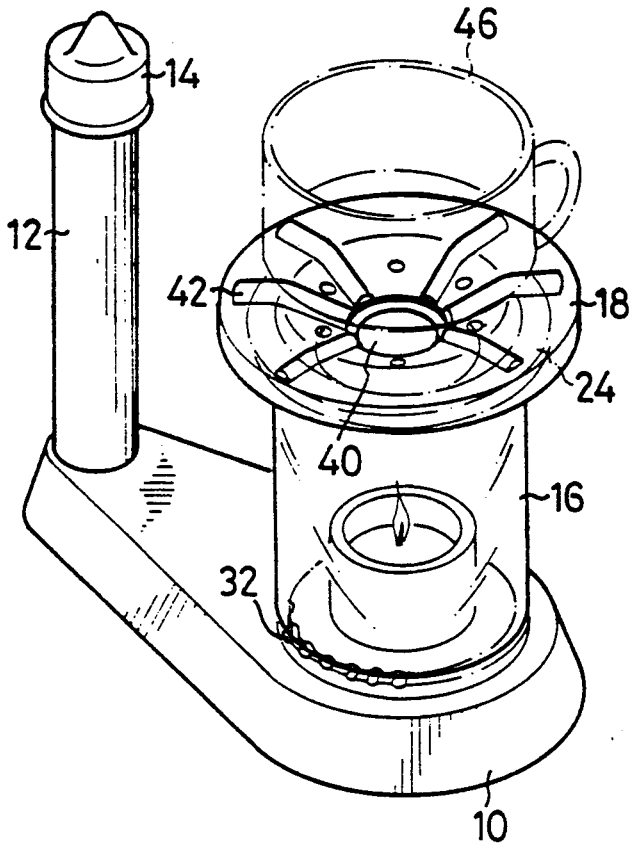
FIG. 4 is a perspective view illustrating a warming device function in accordance with the present invention.

In use, as illustrated in FIG. 4, a user removes the wind shield 16, and lights the candle 22, and replaces the wind shield 16. Fragrance is placed in the recess 38 of the bowl 24, and a cup 46 is placed on the ribs 42 of the upper supporting means 18. Convection introduces fresh air into the wind shield 16 via the vents 32. Heat and warm air from the candle heat the bowl 24, which volatilizes the fragrance, perfuming the room. Then, the heat and warm air flow upwardly through the openings 36 and 40 of the upper supporting means 18, respectively, and through the holes 44, thereby warming the cup 46. When the user wants to extinguish the candle 22, the above-described procedure is reversed, and the extinguisher 14 is placed over the flame. It should be know that any other suitable burning device, such as an oil-burning device, may be used in place of the candle retainer 20 and candle 22.

Figure 5:
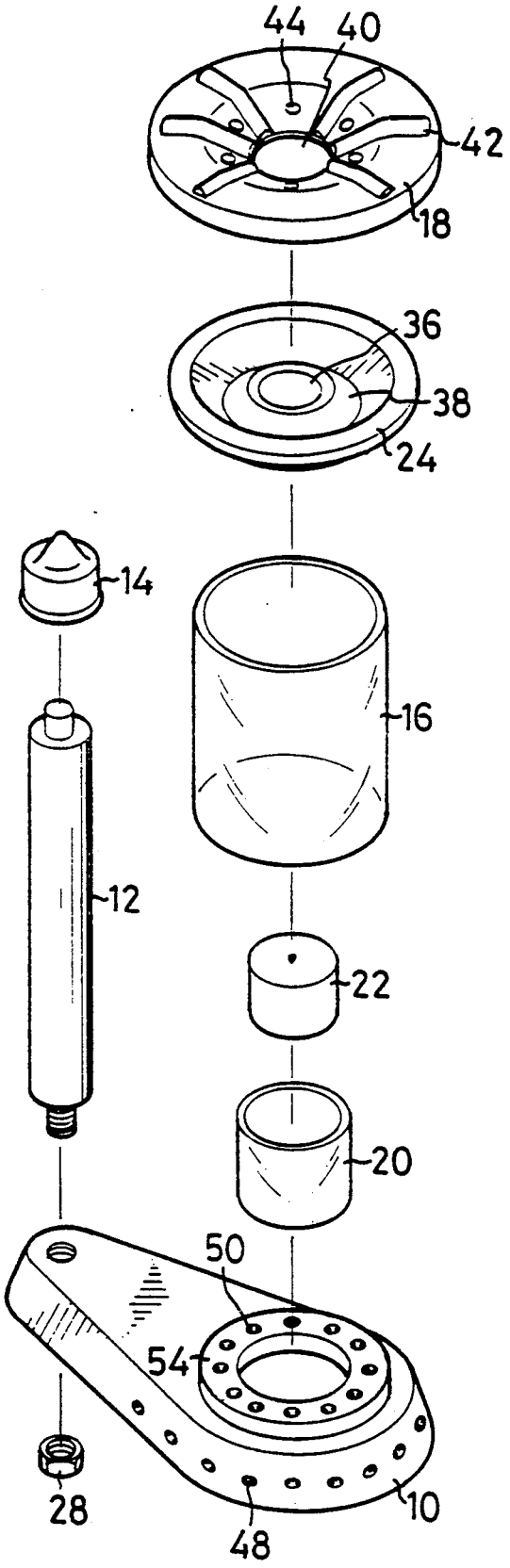
FIG. 5 is a perspective view of a candle holder of another embodiment in accordance with the present invention.
Figure 6:
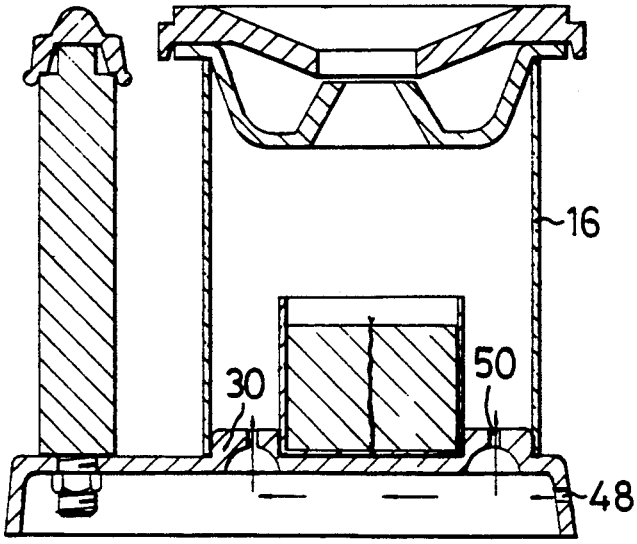
FIG. 6 is a cross-sectional view of the candle holder of FIG. 5.

Now with reference to FIGS. 5 and 6, another preferred embodiment in accordance with the invention is shown. This embodiment is substantially the same as that of the FIGS. 1 to 4 expect that a plurality of vents 48 is formed in a side wall of the base 10 and a plurality of vents 50 is formed in an upper surface 54 of the positioning seat 30. As indicated by the arrow in FIG. 6, fresh air is introduced by convection into the wind shield 16 via the vents 48 of the base 10 and the vents 50 of the positioning seat 30.

Although the invention has been explained in relation to its preferred embodiments, it is to be understood that many other possible modifications and variations can be made without departing the spirit and scope of the invention as hereinafter claimed.

I claim:

1. A candle holder comprising a base having a positioning seat formed thereon for receiving a candle thereon, a wind shield being placed on said seat, venting means for introducing fresh air into said wind shield being formed in said base, a supporting means for supporting an article to be heated having a first opening formed therein and being placed on a top of said wind shield, and a bowl placed between said wind shield and said supporting means for holding fragrance to be volatilized by heat from said candle, said bowl having a second opening communicating with said first opening of said supporting means, whereby when said candle is lit, fresh air is introduced into said wind shield by convention through said venting means and heat from said candle warms the article.

2. A candle holder as claimed in claim 1, wherein said venting means comprises a plurality of vents formed in said positioning seat therebetween said wind shield.

3. A candle holder as claimed in claim 1, wherein said venting means comprises a plurality of first vents formed in a sidewall of said base and a plurality of second vents formed in said positioning seat within said wind shield.

4. A candle holder as claimed in claim 1, wherein said first opening of said supporting means is formed in a central portion thereof and said supporting means further has a plurality of ribs formed thereon for holding the article thereon and a plurality of vents formed therein for conducting warm air and vaporized fragrance therethrough.

5. A candle holder as claimed in claim 4, wherein said ribs extend radially outward from said opening.

6. A candle holder as claimed in claim 1, wherein said second opening of said bowl is formed in a middle portion thereby and is defined by an upwardly-conical portion, thereby defining a recess therearound for holding fragrance.

7. A candle holder as claimed in claim 1, further comprising a handle attached to said base for carrying said candle holder.

8. A candle holder as claimed in claim 7, further comprising an extinguisher for extinguishing a flame of said candle placed on top of said handle.

9. A candle holder as claimed in claim 1, further comprising a candle retainer for holding said candle.

10. A candle holder as claimed in claim 9, wherein said position seat further has a socket formed therein for holding said candle retainer.

11. A candle holder as claimed in claim 1, wherein said wind shield is made of transparent material.

* * * * *